United States Patent [19]

Koerber

[11] 4,281,744

[45] Aug. 4, 1981

[54] ROTARY WHEELCHAIR LIFT APPARATUS

[76] Inventor: Charles F. Koerber, 8905 Mentor Ave., Mentor, Ohio 44060

[21] Appl. No.: 18,640

[22] Filed: Mar. 8, 1979

[51] Int. Cl.[3] ..... B66B 9/20

[52] U.S. Cl. ..... 187/9 R; 414/540

[58] Field of Search ..... 187/9 R, 9 E, 10, 24, 187/8.61, 95, 6; 414/540, 541, 537, 659, 921; 280/166, 163; 105/150, 155; 104/95

[56] References Cited

U.S. PATENT DOCUMENTS

| | | | |
|---|---|---|---|
| 2,309,123 | 1/1943 | Kiesling | 187/95 |
| 3,088,545 | 5/1963 | Meyer | 187/6 |
| 3,350,820 | 11/1967 | Stonely | 187/24 |
| 3,651,965 | 3/1972 | Simonelli et al. | 414/540 |
| 4,124,097 | 11/1978 | Hanks et al. | 187/9 R |
| 4,124,130 | 11/1978 | Rohms et al. | 414/921 |
| 4,133,437 | 1/1979 | Gates | 187/24 |

*Primary Examiner*—Robert J. Spar
*Assistant Examiner*—Kenneth Noland
*Attorney, Agent, or Firm*—Watts, Hoffmann, Fisher & Heinke Co.

[57] ABSTRACT

A wheelchair lift apparatus of rotary construction including an improved carriage lift assembly adapted to receive a wheelchair for mounting in the slide-door opening of a vehicle, such as a van or the like, for automatically lifting the wheelchair user from ground level into and out of the van via the side-door opening while under the user's complete control and without any need for the user to leave the wheelchair.

4 Claims, 8 Drawing Figures

ROTARY WHEELCHAIR LIFT APPARATUS

BACKGROUND OF THE INVENTION

The present invention relates generally to the field of apparatus for moving persons into and out of a vehicle and more specifically relates to an improved construction and arrangement for a rotary wheelchair lift apparatus adapted to receive a conventional type wheelchair for moving a user into and out of a vehicle, such as a van or the like, of the type which incorporates a side-door opening whereby the user can easily and quickly be moved from ground level by an initial vertical lifting movement and then by a rotary pivotal movement into the van via the side-door, and then being able to reverse the procedure with the user having full control of the lift apparatus while sitting in the wheelchair to obviate any requirement to leave the wheelchair at any time. The lift apparatus of the present invention is especially suited to the use by disabled persons confined to a wheelchair mode life-style, such as paraplegics and other such disabled persons.

With the advent of our society's desire to participate in various outdoor activities there has been a great expansion in the interest for outdoor recreation particularly in respect to outdoor travel via recreational vehicles, such as recreational vans commonly referred to as RV's. Fortunately, this interest in recreational vehicles has extended itself to disabled persons confined to a wheelchair life-style of living. Such persons including a great number of war veterans have sought to extend their participation in recreation along with others by being able to utilize rather technically sophisticated recreational vans or van conversions which enables the wheelchair user to drive the vehicle under his own control such as by substituting the conventional driver's seat for the wheelchair itself, for example. With this there has been developed a need for an efficient, reliable and safe system which can move the user sitting in his wheelchair into and out of the vehicle with a minimum of effort and yet at a relatively low cost.

Heretofore, various types of devices and/or arrangements have been provided to move the user into and out of the vehicle. One such arrangement has been to utilize various ramp or lift mechanisms associated with the rear or side door of the van. However, these arrangements are not especially satisfactory since they require a lot of working area not conducive to limited parking areas and are not as convenient or easy to operate by the user while sitting in the wheelchair. In another arrangement, a rotary type lift apparatus has been provided for use with the side-door of the vehicle, as disclosed in U.S. Pat. No. 3,516,559, for example. In this particular lift apparatus there is not provided the structural and/or functional advantages afforded by the present invention for the reasons which will become apparent hereinafter.

SUMMARY OF THE INVENTION

The present invention relates to an improved rotary wheelchair lift apparatus which comprises a carriage lift assembly including a platform adapted to receive a wheelchair of standard construction. The carriage lift assembly includes an improved support column subassembly which mounts the platform via a plurality of rollers of generally frusto-conical construction adapted for rolling engagement on confronting generally planar surfaces of a support column member for smooth and safe operation with a minimum of "sway" to the platform mounting the wheelchair and with no bending or torquing of the components including the screw drive mechanism.

In the invention, the screw drive mechanism is mounted on the vehicle chassis, i.e. 4, and extends generally parallel to the support column member and threadably connects with the carriage lift assembly while moving the lift platform vertically upwardly and downwardly upon energization from a drive mechanism mounted on the vehicle chassis, i.e. 4. The upper end of the drive mechanism is operably connected to another drive motor for rotating the carriage lift assembly about the vertical axis of the column member and into and out of the vehicle via the side-door thereof. In the invention, the respective drive motors operate via gear and pulley mechanisms operable by a control circuit which is energized from the conventional vehicle battery.

In the invention, the support column and screw drive mechanism are constructed and arranged to provide a predetermined "lost motion" so that the lift platform can be completely grounded in the down-position to provide stability to the system upon a continued overdrive of the drive motor for the screw mechanism. This "lost motion" or play in the system is approximately 2 inches in respect to travel on the support column so as to accommodate vehicles, such as vans, having a ground-to-floor heighth of between 25 and 27 inches. This then would accommodate one/half or three/quarter or one ton vans.

In the invention, there is further provided an improved frame structure for mounting the lift platform which incorporates the control levers for easy access by the user for controlling vertical and rotary movements of the carriage lift assembly. The frame structure further mounts a table-drive assembly operably associated with a stop mechanism mounted on the platform adapted to be automatically raised and lowered in response to vertical movement of the carriage lift for preventing the wheelchair from rolling off the platform during normal use of the lift apparatus.

From the foregoing, it will be seen that the present invention provides an improved rotary wheelchair lift apparatus which is of a compact, safe and reliable construction which enables wheelchair users to get up-and-down and in-and-out of vehicles such as vans or similar types of vehicles without the need for leaving the wheelchair. The drive system for the lift apparatus is completely electric and operates the lift apparatus up and down at a smooth, safe speed and can be stopped at any position via finger-tip control accessible to the user on the frame structure. At ground level the user simply wheels off the platform or ramp, actuates a switch which then automatically returns the carriage lift assembly to its original position inside the van.

The lift apparatus of the present invention allows one to use a normal vehicle parking space. Accordingly, there is no longer the problem of the user being trapped outside the van by reason of another car being parked in the next space. In this regard, the lift apparatus sits completely inside the van and utilizes a minimum amount of interior van space.

In the invention, the lift apparatus requires no major modification to the vehicle. It can be installed, removed, and re-installed in another van, as desired. Significantly, the lift apparatus is completely electric. Accordingly, there are no hydraulic cylinders requiring endless maintenance, no hydraulic cylinders to malfunction in the wintertime, and no messy oil leaks to clean up.

DESCRIPTION OF THE PREFERRED EMBODIMENTS

Figure 1:
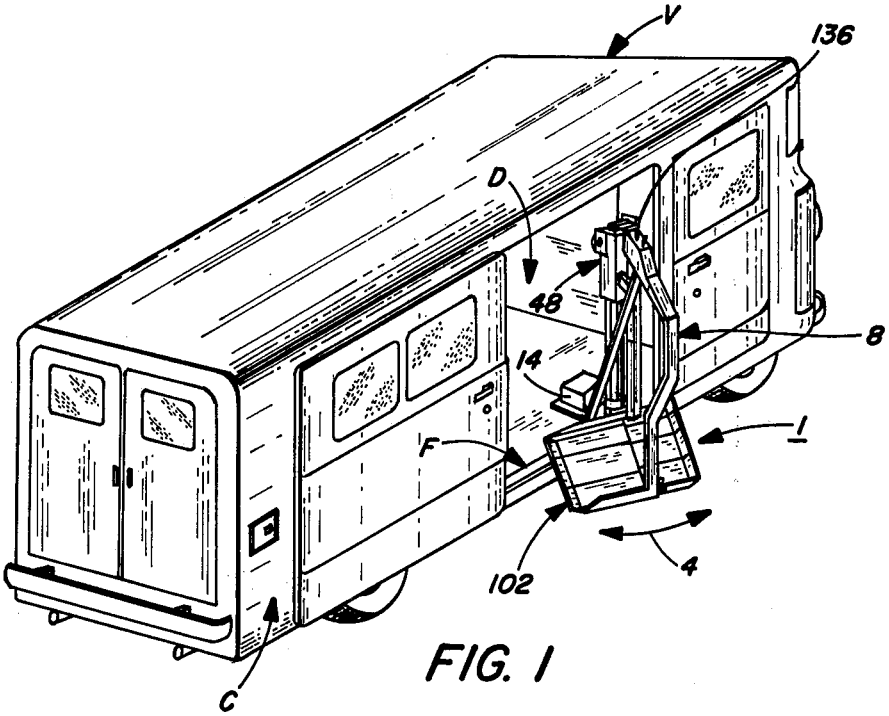
FIG. 1 is a generally perspective view illustrating the rotary wheel chair lift apparatus of the invention installed in the side-door opening of a vehicle, such as a van.

Referring now again to the drawings and specifically to FIG. 1 thereof, there is illustrated the wheelchair lift apparatus, designated generally at 1, of the present invention. As shown, the apparatus 1 is installed for use with a conventional vehicle V, such as a recreational van or the like. As shown, the lift apparatus 1 is disposed within the side-door opening D of the vehicle adapted for rotational movement about a generally vertical axis, as shown by the arrows, at 4. Accordingly, the lift apparatus is adapted to swing inwardly and outwardly within the opening D of the van to provide ingress and egress to the user, such as an invalid. Specifically, this pivotal movement about the vertical axis, as at 4, is illustrated in FIG. 6 which illustrates the lower drive mechanism, designated generally at 19, for the lift apparatus 1.

Figure 3:
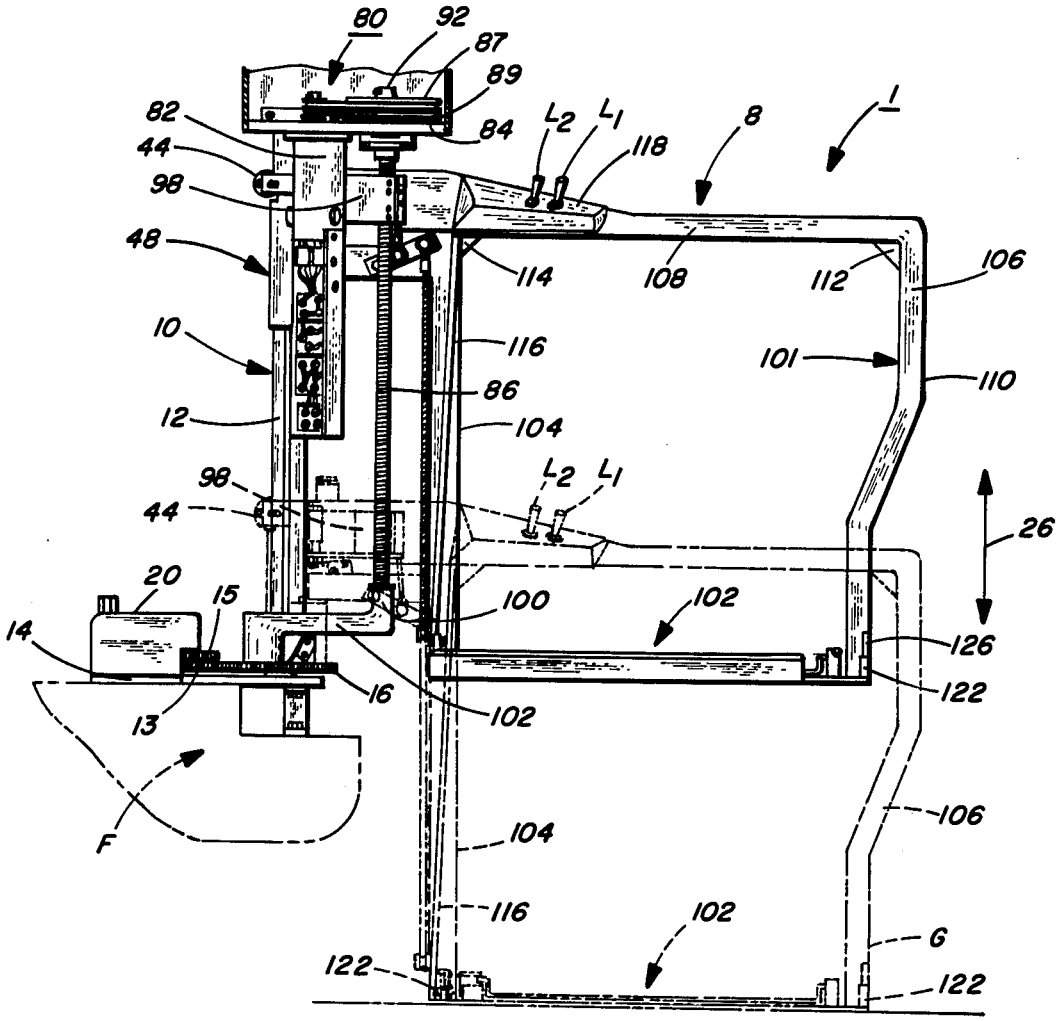
FIG. 3 is a fragmentary, side elevation view, partly in section, illustrating the lift apparatus of the invention.

As best seen in FIG. 3, the lift apparatus 1 is mounted on the floor F of the vehicle chassis C. More specifically, the lift apparatus 1 includes a carriage assembly, designated generally at 8, which is mounted on the floor F of the chassis C as aforesaid.

In the form shown, the carriage assembly 8 includes a column support mechanism 10 which comprises a vertically disposed column member 12 (FIG. 3) which is mounted on a base plate 14 (FIGS. 3 and 6) which, in turn, is mounted on the floor F of the chassis. As shown, the lower end of the column 12 is fixly attached to a driven segment gear 16 for rotation about a vertical axis. Specifically, it will be seen that the base plate 14 is disposed in the same general plane as the surface of the floor F chassis. The segment gear 16 is disposed in vertically spaced relation above the base plate 14 and is fixably attached, as at 18, to the column 12 (FIG. 6) as to rotate the column 12 vertically about its axis upon activation of a motor drive mechanism, designated generally at 20. The segment gear 16 is driven by a drive gear 13 (FIG. 3) via a drive gear 15 actuated by drive motor 20, as seen in FIG. 6. Preferably, the segment gear 16 is of a generally 90° configuration so as to impart a corresponding full 90° rotation of the column 12 about its vertical axis and so as to correspondingly rotate the lift apparatus 1 through 90° inwardly and outwardly of the door opening D.

Figure 6:
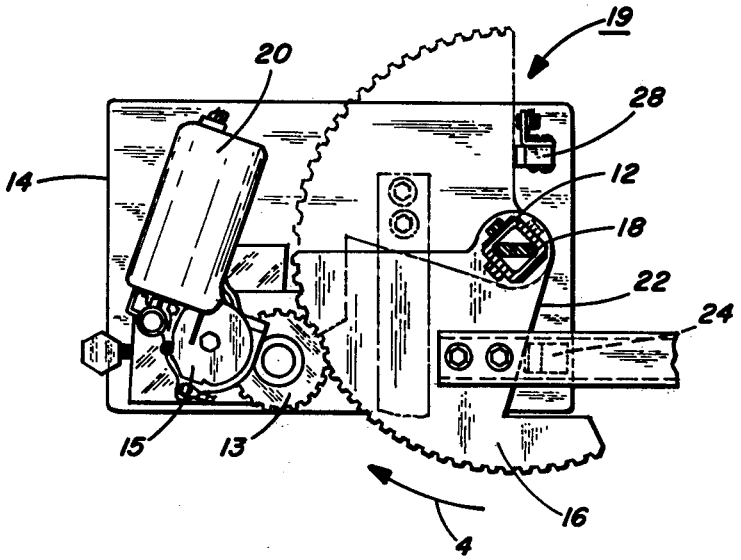
FIG. 6 is a fragmentary top plan view looking down on the motor and gear drive mechanism for rotating the support column about a vertical axis as illustrated in FIG. 3.

In operation, as best seen in FIG. 6, the segment gear is shown in solid line so that the lift apparatus 1 is swung outwardly completely 90° to its full open position. As shown, this would be at right angles in respect to the door opening D whereas, the illustration in perspective view of FIG. 1 illustrates the lift apparatus 1 disposed generally at approximately 45°. In FIG. 6, the lift apparatus 1 is in the full open or 90° position to receive the user. In this position, an inclined cam surface 22 (FIG. 6) activates the limit switch 24 (FIG. 6) which de-activates the motor 20 to enable the user to lower the lift apparatus 1 vertically to the ground position, as seen in dotted line at G in FIG. 3. In the reverse operation, the lift apparatus 1 is raised vertically upon actuation of the motor 20 via lever L, which raises the lift apparatus 1 vertically, as illustrated by the arrow 26 to the solid line position illustrated in FIG. 3. The user then actuates another lever L2 so as to pivot the lift apparatus 1 inwardly about a generally horizontal plane upon rotational movement of the column 12 about its vertical axis. This rotational movement brings the segment gear 16 through a rotation of approximately 90° so as to engage another limit switch 28 (FIG. 6) which then again deactivates the motor 20 which seats the lift apparatus carrying the user in grounding engagement with the floor F of the chassis of the vehicle, as illustrated in broken line in FIG. 3.

In the form shown, the control includes the lever L, which activates the control circuit (not shown) for raising the lift apparatus 1 vertically, as illustrated by the arrow 26 in FIG. 3. The lever L2 actuates the control circuit (not shown) for rotating the lift apparatus 1 into and out of the van about a generally horizontal plane.

Figure 4:
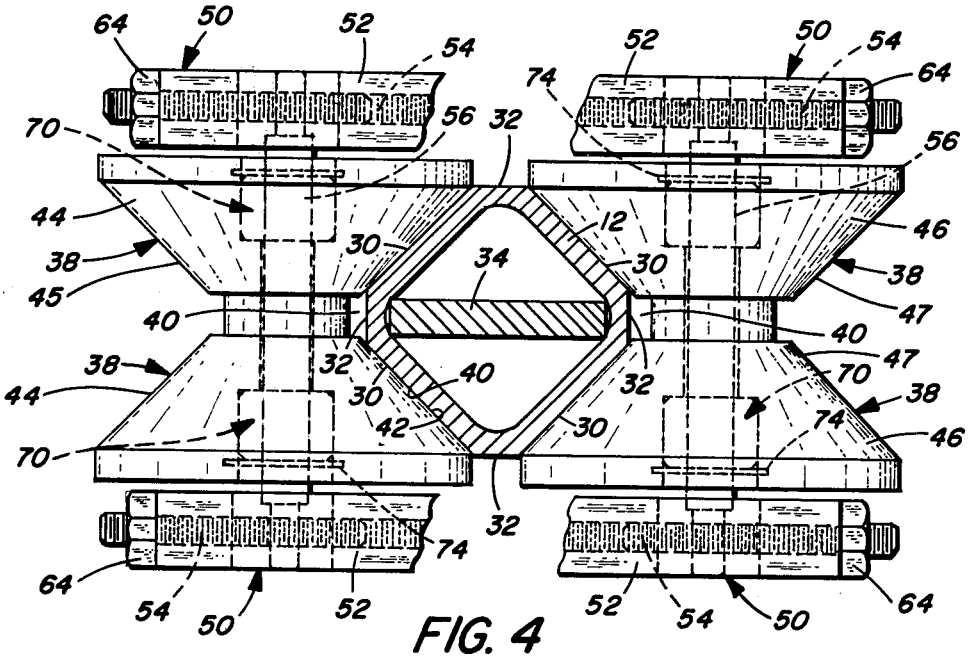
FIG. 4 is a fragmentary, section view, on a large scale, taken along the line 4—4 of FIG. 2.

In accordance with the invention, the column assembly 10 includes the column member 12 which, as illustrated in cross-section at FIG. 4, is of a polygonal, such as square-cross-sectional configuration. Specifically, the column 12 has four generally planar sides, as at 30, connected by generally flat edge portions, as at 32. In the invention, it is to be understood that the surfaces 32 could be other than flat so as to include some degree of radius, as desired. Preferably, the column 12 includes an interior strengthening plate 34 which preferably extends transversely between the flats, as at 32. Preferably, the plate 34 may extend throughout the full vertical length of the column 12 or less than such length, as desired.

Now in the invention, there is employed a plurality of bearing members, designated generally at 38, for friction rolling engagement on the column member 12. Preferably, the roller bearing arrangement is structured and arranged so as to provide relief areas, as at 40, to enable full surface-to-surface engagement between the confronting surface, as at 40, of the column 12 (FIG. 4) with the corresponding confronting surface, as at 42, of the respective rollers 44 and 46.

Figure 2:
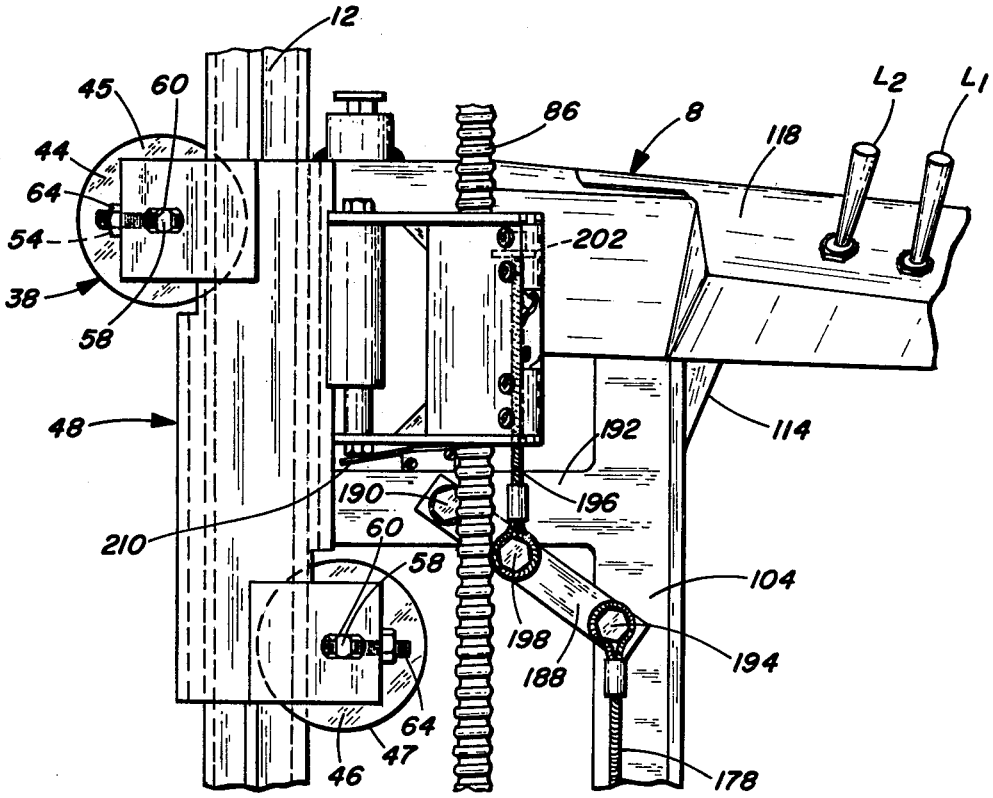
FIG. 2 is a fragmentary side elevation view, on an enlarged scale, illustrating the upper portion of the support column and carriage lift assembly of the invention.

In the form shown in FIG. 3, the rollers 44 are mounted upwardly on a roller housing assembly 48 and the rollers 46 are mounted downwardly of the assembly 48, as best seen in FIG. 2. It will be seen that the upper rollers 44 include two individual generally frusto-conical rollers 45 and the lower rollers 46 include two individual generally frusto-conical rollers 45 and the lower rollers 46 include two individual generally frusto-conical rollers 47 which engage, by rolling, the column 12, as best seen in FIG. 4.

As best seen in FIG. 4, the roller assembly 38 incorporates with each of the four (4) wheels 45 and 47 an adjustment device, designated generally at 50, which are of identical construction. Each adjustment device 50 includes a mounting block 52 fixably attached to the roller assembly 48. An adjustment screw 54 (FIG. 4) is threadably connected to an axle 56 which rotatably mounts the respective rollers 45 and 47 of the respective roller assemblies. The axle 56 is provided at its opposite ends with bearing surfaces, as at 58, which are disposed for sliding movement within slots, as at 60, provided in the mounting blocks 52 for limiting axle adjusting movement of the screw within the block 52. Preferably, the screws are axially adjustable via fasteners, such as nuts 64, so as to provide selective adjustment of the rollers 45 and 47. This adjustment enables full surface-to-surface engagement at a generally 45° orientation of the respective rollers 45 and 47 with the confronting planar surfaces 30 of the column 12.

Preferably, each of the wheels 45 and 47 is provided with an internal anti-friction bearing mechanism, designated generally at 70. Each of the mechanisms 70 include a bearing member which is commercially available. This bearing member is press-fit within the respective rollers 45 and 47 and maintained against axial movement by a retainer ring 74.

Figure 5:
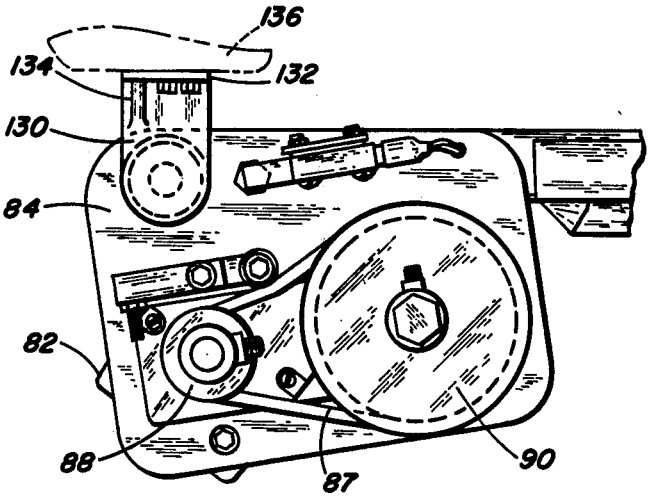
FIG. 5 is a fragmentary top plan view, on a large scale, looking down on the carriage lift and drive assemblies illustrated in FIG. 3.

As best seen in FIGS. 2, 3 and 5, the lift apparatus 1 includes an upper drive assembly, designated generally at 80, for moving the lift apparatus 1 horizontally on the column assembly 10. As shown, this upper drive assembly 80 includes a drive motor 82 fixably mounted on a top support plate 84 which is fixably attached to the upper end of the column 12. The drive motor 82 (FIG. 3) is operably connected to a drive screw 86 via a pair of drive pulleys 88 and 90 (FIG. 5) connected by two (2) belts 87 and 89 to the input drive end 92 (FIG. 3) of the drive screw. The drive screw 86 is mounted at one end to a bracket 98 which is fixably attached to the roller assembly 48. The lower end of the drive screw 86 is mounted for rotation within a bearing, as at 100, which, in turn, is attached to a bracket member 102 (FIG. 3) fixably attached to the segment gear 16. Preferably, the bearing 100 is of a plastic, such as Teflon material, or the like. As best seen in FIG. 3, the bracket 98 is illustrated in solid line when the lift apparatus is in the full vertically oriented "up" position and in dotted line in the full vertically oriented "down" position.

In the invention, the lift apparatus 1 comprising the carriage assembly 8 includes a frame structure, designated generally at 101, which is of a generally inverted U-shaped configuration as best illustrated in FIG. 3. More specifically, the structure 101 includes a generally planar ramp or platform 102 which is carried by a pair of oppositely disposed side columns 104 and 106 which are interconnected at their top ends by a cross member 108. As shown, the outerward support column 106 is inclined to provide an offset portion as at 110 to provide sufficient clearance for the wheelchair user. The members 108 and 106 are interconnected by a strengthening gusset, as at 112, to provide rigidity between the component parts. Similarly, the parts 104 and 108 are provided with another gusset, as at 114, for the same purpose. As shown the inner column 104 is provided with a brace member 116 which is fixably attached at its lower end to the platform 102.

As best illustrated in FIG. 3, the cross member 108 is provided at its inner end with a control box, designated generally at 118, which mounts the controls L1 and L2, as aforesaid.

Figure 7:
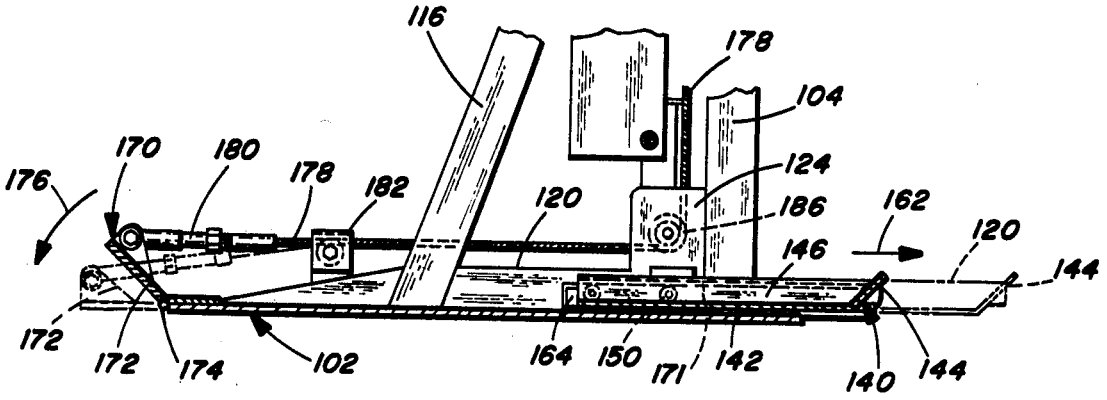
FIG. 7 is a fragmentary vertical section view taken along the line 7—7 of FIG. 8.

As best seen in FIG. 7, the platform 102 is provided with a pair of oppositely disposed strengthening side plates 122 which are made integral with and are disposed in generally vertically upstanding relation in respect to the platform 102. As shown, the inner side plate 120 (FIG. 7) is fixably connected, as by weldments, to the inner column member 104 and to the brace member 116. Also, the side plate member 120 includes an integral flange 124 which provides a support for a freely rotatable pulley 186, as will be hereinafter more fully described. As shown, the other outer side plate 122 (FIG. 3) includes a further gusset, as at 126, for strengthening the inner connection between the side plate member 122 and the outer column member 106. It will be seen, therefore, that the frame structure defined by the columns and cross members 104, 106 and 108 define a generally inverted U-shaped configuration which is disposed substantially in the same general vertical plane with the support column member 12 which mounts the roller housing assembly 48. Similarly, the drive screw 86 is disposed in a generally vertical parallel relationship in respect to the support column 12, as best illustrated in FIGS. 2 and 3. In the invention, this parallel relationship between the component parts is achieved by a mounting bracket, as at 130, which is fixably attached at one end, as at 132 to the distal end of the support column 12 (FIGS. 1 and 5) and at the other end via a flange 134 secured, such as by screws and the like, to the column 136 of the vehicle. This bracket provides a structural support for maintaining the parallel relationship between the parts and the perpendicular relationship of these parts in respect to the floor F of the vehicle chassis.

Figure 8:
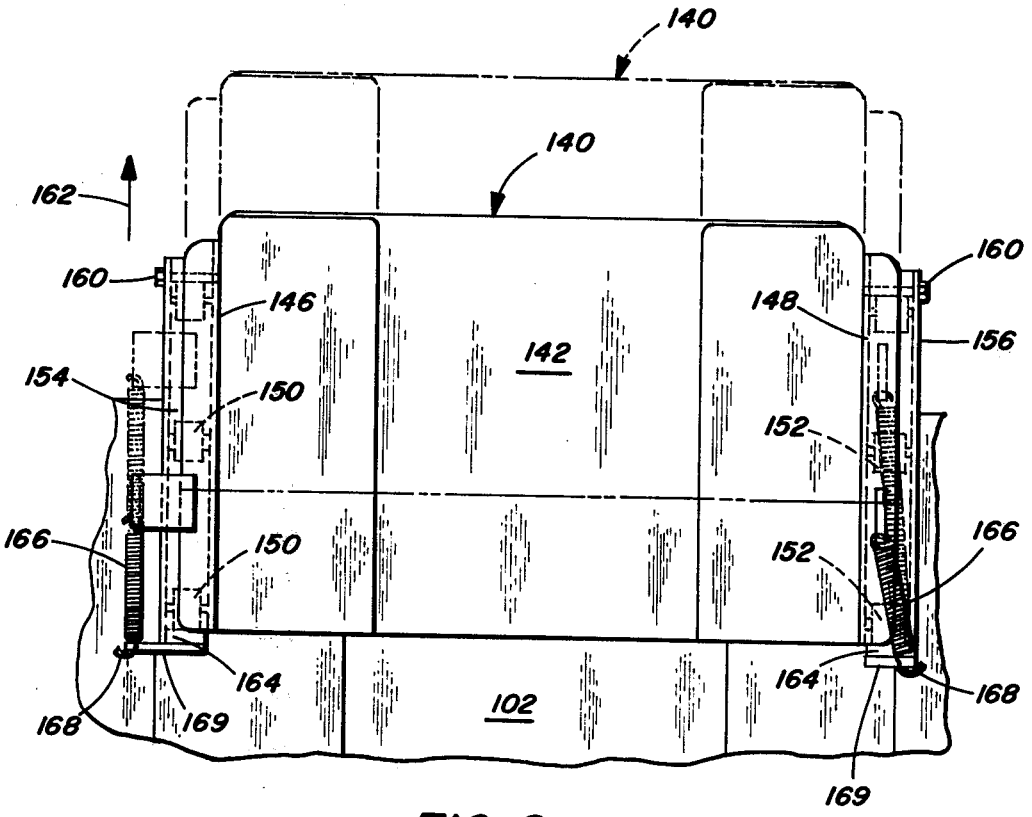
FIG. 8 is a fragmentary, top plan view looking down on the lift platform illustrated in FIG. 3.

As best illustrated in FIGS. 7 and 8, the platform 102 of the frame structure 8 includes a forward stop mechanism, designated generally at 140, disposed for horizontal reciprocal movement on the platform member 102. More specifically, this mechanism includes a support plate 142 which has an upturned end, as at 144, adapted to prevent forward rolling movement of the wheelchair when installed thereon. The support plate 142 includes a pair of oppositely disposed integral flanges 146 and 148 of generally inverted L-shaped configuration. Each of the flanges mounts a pair of rollers 150 and 152 adapted for rolling engagement within correspondingly shaped U-shaped channel members 154 and 156 fixably attached to the platform 102. The guide channels 154 and 156 each include a pair of stop elements 160, which serve to limit and provide a stop for the rollers and hence, forward movement of the mechanism 140 as illustrated by the arrow 162 in FIGS. 7 and 8. More specifically, the stopping movement occurs when the rollers 152 are brought into abutment with the stops 160. The opposite end of the guide members 154 and 156 are provided with elastomeric stop members (rubber) 164 which served to provide a cushion upon resilient retracting movement of the mechanism 140. The retracting movement of the mechanism is automatically accomplished by a pair of oppositely disposed extension spring elements 166 which are attached at one end, as at 168, to flanges 169 on the respective guide members 154 and 156 and at the other end to the side flanges 146 and 148, as best seen in FIG. 8. By this arrangement, the forward stop mechanism 140 is disposed for reciprocal movement in a generally horizontal plane parallel to the general plane of the platform 102 so as to enable the wheels (not shown) of the wheelchair to engage the stop 144 so as to drive the assembly forward throughout its full through (dotted line FIG. 7) so that the rearwardmost ends of the flanges 146 and 148 are disposed generally at the center-line, as at 171, of the oppositely disposed column member 104 and 106. In this position, it has been determined that the wheels of the wheelchair can be supported by and transferred forwardly to a point sufficient such that the center of gravity, i.e. the load, of the wheelchair user including the wheelchair, is disposed slightly forward of the generally vertical plane defined by the generally inverted U-shaped structure 102 of the frame. Preferably, this load distribution is disposed at such center line or forward of the same so as to prevent accidental rolling movement of the wheelchair rearwardly and off of the lift platform during normal use thereof.

As best seen in FIG. 7 a rear stop mechanism, designated generally at 170, is provided to prevent inadvertent rearward rolling movement of the wheelchair off of the platform 102. As shown, the mechanism includes a rear stop plate member 172 which is pivotably attached to the platform 102 via an elongated piano-type hinge spring 174 which is fixably attached, as by weldments, to the platform 102 and the stop 172. As best seen in FIG. 7, this spring hinge biases the stop plate 172 forwardly or in a counter-clockwise direction, as illustrated by the arrow 176. The stop plate 172 is actuated by means of the cable 178 which is fixably attached by a turn buckle, as at 180, and then threaded through a guide roller 182 and then around a guide roller 186 fixably mounted on the flange 124. At this juncture, the cable takes a 90° turn and extends vertically upwardly generally parallel to the inner column member 104 and attached at its free end to a pivotal link 188. The link 188 is pivotally attached at one end, as at 190, (FIG. 2) to a cross member 192 which is integrally connected between the roller assembly 148 and the inner column member 104. As shown, the free end of the cable 178 is attached, as at 194, adjacent the free end of the cable 178 is attached, as at 194, adjacent the free end of the pivot link 188. As best seen in FIG. 3, another cable member 196 is fixably attached, as at 198, to the pivot link 188 generally intermediate its ends. The cable 196 is fixably attached at its other end, as at 202, to a ball screw assembly 204 which receives the drive screw 86 for raising and lowering the carriage lift assembly 48 in a generally vertical direction.

The operation of stop mechanism 170 can be illustrated with reference to FIGS. 3 and 7. As shown, in the full-up or solid line position illustrated in FIG. 3, the pivot link 188 is disposed in a generally 45° orientation. In this condition, the upper cable 196 is held in a taut condition by means of the upward force exerted by the ball screw assembly 204, whereas, the lower cable 178 is only under sufficient tension so as to maintain the stop member 172 in the upward position, as illustrated in FIG. 7, so as to override the biasing force of the piano spring hinge 174 thereby to hold the stop member 172 in a generally 45° opientation in relation to the platform 102. Upon actuation of the outer lever L1 the carriage lift assembly 8 is vertically lowered with the cables 196 and 178 maintained in a relatively constant load condition until platform 102 bottoms out with the ground. After grounding, continued actuation of the outer lever L1 acts to overdrive the upper drive motor 82 which, in turn, drives roller drive screw 204 downwardly. This movement causes the upper cable 196 to slack and the lower cable 178 to become under tension due to the resilient biasing of the piano spring hinge 174. This causes pivotal movement of the pivot link 188 in a generally clockwise direction (FIG. 2) which enables the stop plate member 172 to pivot downwardly, as shown by the arrow 176 (FIG. 7) into the general plane of the platform member 102. In this position, a limit switch 210 mounted on the cross member 192 is contacted which stops further vertical downward movement of the ball screw 204.

In the invention, the cable 178 has a 2000 p.s.i. at test capability and the stop plate 172 has a 1600 p.s.i. force capability. The lift platform 102 has a lifting capacity of 960 pounds and a stationary load capacity of 2000 pounds. The upper motor 82 has a 3000 r.p.m. and draws 28 amps at a 400 lbs. loading capacity on the platform. In the invention, there is at least a 2 to 1 safety factor in respect to the V.A. recommended lift capacity at 400 lbs.

In a technical operation, with the user then positioned on the platform 102, he merely actuates the switch lever L1 which actuates motor 82 via cables 88 and 90 to rotate the screw 86 in the stationary ball screw 204 which is fixably attached to the support column 12. This raises the platform 102 to the desired height, as illustrated in solid line in FIG. 3, whereupon the lift will stop automatically upon actuation of a suitable limit switch (not shown) being utilized to automatically de-energize the motor 82. At this position, the user then actuates the other control lever L2 which activates drive motor 20 (FIG. 6) so as to rotate the lift to the door D into the van. He then again actuates control L1 so as to automatically lower the lift and platform 102 to the floor F of the van. Automatic operation of the forward stop mechanism 140 and the rear stop mechanism 170 operate during this sequence of this steps, as aforesaid. Accordingly, reversal of the above steps enables the user to readily discharge himself from the van once again to ground level, all accomplished automatically under his own control in accordance with the advantages of the present invention.

I claim:

1. A rotary wheel chair lifting apparatus for lifting a user into and out of a vehicle of the type having a side door opening, such as a van, recreational vehicle, or the like, the lifting apparatus including:

a support column adapted to be mounted adjacent said door opening;

said support column constructed to have a polygonal cross-sectional configuration;

a drive means for rotating said support column about a vertical axis, including a drive motor with drive gear means driving a gear means attached adjacent the lower end of said support column;

a carriage assembly mounted for rolling engagement on said support column, the carriage assembly including a carriage member having at lease two oppositely disposed generally V-shaped rollers, each roller engaging two adjacent surfaces of said support column;

the V-shaped rollers being of a configuration and location within said carriage member as to control;

a frame structure including a support platform mounted on said carriage assembly for receiving a wheelchair;

a drive screw means for raising and lowering said support platform platform in a vertical direction including an elongated screw member disposed in driven relationship with a screw drive motor attached to the upper end of said screw member, and a threaded engaging portion attached to said support column and said carriage assembly for raising and lowering said support platform upon actuation of said screw drive motor;

said support platform having a forward stop means including a resiliently biased support member adapted for recriprocal movement upon engagement with wheels of said wheelchair;

said support platform having a rear stop means including a hinged stop operably associated with a cable and pulley means for the automatic raising and lowering of said stop means upon raising and lowering of said frame structure, a control means on the frame for actuating the vertical and pivotal motion of said apparatus;

the V-shaped roller include a means by which engagement between the rollers and said support column may be adjusted thereby establishing play between said support column and said carriage member, and an adjustment screw threadably connected to one axle of the V-shaped roller, the axle protruding through slots in opposing roller mounting block surfaces and having bearing surfaces engaging the slots, the adjustment screw protruding through an aperture in a further carriage member face threadable engaging a tightening means such as a nut whereby the adjusting means is caused to move.

2. The improved wheelchair lifting apparatus of claim 1 in which the two oppositely disposed V-shaped rollers are separated vertically along the carriage member, the lower roller is disposed to engage rolling surface portions of the support column generally below and facing the wheelchair support platform mounting to the carriage assembly, and the upper roller is disposed to engage support column rolling surfaces generally above and not facing the wheelchair support platform mounting to the carriage assembly whereby the upper and lower rollers are subjected to compressive force when any downward force is applied to the wheelchair support platform.

3. The wheelchair lifting apparatus of claim 1 in which said support column is of a hollow construction having a generally rectangular cross-sectional configuration and including an internal stiffener.

4. In a wheelchair lifting apparatus having a support column of generally polygonal cross-sectional configuration and having a frame structure including a wheelchair support platform mounted on a carriage assembly engaging the support column, where the carriage is in a vertically driven relationship to the support column and the support column is in a pivotally driven relationship about an axis defined by the length of the support column, an improved carriage assembly including:

a carriage member having at least two oppositely disposed generally V-shaped rollers, each roller engaging two adjacent surfaces of the polygonal support column, and the V-shaped rollers being a configuration and location within the carriage member as to control, (i) relative rotational motion between the carriage member and support column about an axis defined by the length of the support column, (ii) binding between carriage member and support column induced by any downward torque applied to the carriage assembly generally parallel to the support column axis, the V-shaped rollers include ameans by which engagement between the rollers and said support column may be adjusted thereby establishing play between said support column and said carriage member, and an adjustment screw threadably connected to one axle of the V-shaped roller, the axle protruding through slots in opposing roller mounting block surfaces and having bearing surfaces engaging the slots, the adjustment screw protruding through an aperture in a further carriage member face threadably engaging a tightening means such as a nut whereby the adjusting means is caused to move.

* * * * *